US011412813B2

(12) United States Patent
Lopez et al.

(10) Patent No.: US 11,412,813 B2
(45) Date of Patent: Aug. 16, 2022

(54) VIBRATORS IN CELLS FOR FOOTWEAR

(71) Applicant: HEWLETT-PACKARD DEVELOPMENT COMPANY, L.P., Houston, TX (US)

(72) Inventors: Matthew G. Lopez, San Diego, CA (US); Roya Susan Akhavain, San Diego, CA (US); Edward Ponomarev, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 484 days.

(21) Appl. No.: 16/082,568

(22) PCT Filed: Apr. 17, 2017

(86) PCT No.: PCT/US2017/027896
§ 371 (c)(1),
(2) Date: Sep. 6, 2018

(87) PCT Pub. No.: WO2018/194543
PCT Pub. Date: Oct. 25, 2018

(65) Prior Publication Data

US 2020/0305546 A1 Oct. 1, 2020

(51) Int. Cl.
*A43B 13/18* (2006.01)
*A43B 7/144* (2022.01)
(Continued)

(52) U.S. Cl.
CPC ..... *A43B 13/181* (2013.01); *A43B 7/144* (2013.01); *A43B 13/189* (2013.01); *A43B 3/34* (2022.01);
(Continued)

(58) Field of Classification Search
CPC ... A43B 13/181; A43B 13/187; A43B 13/188; A43B 13/189; A43B 7/144; A43B 7/32
(Continued)

(56) References Cited

U.S. PATENT DOCUMENTS 5,363,570 A * 11/1994 Allen ..... A43B 13/20 36/35 B
5,669,161 A * 9/1997 Huang ..... A43B 23/26 36/43
(Continued)

FOREIGN PATENT DOCUMENTS

CN 1386053 12/2002
CN 1531631 9/2004
(Continued)

OTHER PUBLICATIONS

Li Gege et al., Overview on Application of Magnetorheological Fluids in Mechantcal Engineering, Journal of Mechanical Strength, Jun. 28, 2014, pp. 19-25 (English Abstract included).
(Continued)

*Primary Examiner* — Marie D Bays
(74) *Attorney, Agent, or Firm* — Trop Pruner & Hu PC

(57) ABSTRACT

In some examples, an assembly for a footwear includes a cell comprising a housing structure, the cell comprising a first chamber to contain a fluid. The assembly further includes a port and a vibrator responsive to activation to cause a reduction in fluid flow through the port between the first chamber and a second chamber by changing a characteristic of the fluid in the port.

15 Claims, 4 Drawing Sheets

(51) Int. Cl.
*A43B 7/32* (2006.01)
*A43B 3/34* (2022.01)

(52) U.S. Cl.
CPC ..... *A43B 7/32* (2013.01); *A43B 13/187* (2013.01); *A63B 2220/836* (2013.01)

(58) Field of Classification Search
USPC ..... 36/29, 28, 35 B
See application file for complete search history.

(56) References Cited

U.S. PATENT DOCUMENTS

| | | | | |
|---|---|---|---|---|
| 5,830,553 | A * | 11/1998 | Huang | F16F 9/049 428/137 |
| 7,200,956 | B1 * | 4/2007 | Kotha | A43B 3/34 36/1 |
| 7,254,908 | B2 | 8/2007 | Ungari | |
| 9,198,478 | B2 | 12/2015 | Meschter | |
| 10,264,850 | B2 * | 4/2019 | Lam | A43B 17/006 |
| 2004/0154190 | A1 * | 8/2004 | Munster | A43B 7/144 36/114 |
| 2004/0159014 | A1 * | 8/2004 | Sommer | A43B 21/265 36/28 |
| 2004/0177531 | A1 * | 9/2004 | DiBenedetto | A61B 5/1036 36/132 |
| 2006/0248750 | A1 * | 11/2006 | Rosenberg | A43B 1/0054 36/29 |
| 2006/0265907 | A1 * | 11/2006 | Sommer | A43B 21/265 36/28 |
| 2016/0235156 | A1 * | 8/2016 | Stumpf | A43B 7/148 |
| 2016/0235159 | A1 * | 8/2016 | Bauerfeind | A43B 17/023 |
| 2016/0331076 | A1 | 11/2016 | Cook et al. | |
| 2016/0345663 | A1 | 12/2016 | Walker et al. | |
| 2016/0345669 | A1 | 12/2016 | Orand et al. | |
| 2021/0085023 | A1 * | 3/2021 | Bandyopadhyay | A43B 13/206 |
| 2021/0361031 | A1 * | 11/2021 | Mou | A43B 23/029 |

FOREIGN PATENT DOCUMENTS

| | | |
|---|---|---|
| CN | 1638663 | 7/2005 |
| CN | 101083951 | 12/2007 |
| CN | 101600365 | 12/2009 |
| CN | 101677858 | 3/2010 |
| CN | 105163619 | 12/2015 |
| EA | 020955 B1 | 3/2015 |
| KR | 20050116516 | 12/2005 |
| RU | 2193857 C2 | 12/2002 |
| WO | WO-2010079207 | 7/2010 |

OTHER PUBLICATIONS

Zhu Shixing et al. Engineering Application of ER and MR Fluids, Chinese Journal of Rare Materials, Sep. 9, 2003, p. 621-627,vol. 27, No. 5 (English Abstract included).

Swain, "Pressure-Driven Displacement Flow of a Non-Newtonian Fluid by a Newtonian Fluid", Retrieved from internet—http://www.iith.ac.in/~ksahu/pinaki_ms.pdf, 2013, 55 Pages.

* cited by examiner

VIBRATORS IN CELLS FOR FOOTWEAR

BACKGROUND

Various footwear can be worn on the feet of users. Footwear can be used for various purposes, including walking, jogging, playing sports, and so forth. Users desire that footwear be comfortable and provide adequate support when the users are engaged in various activities.

BRIEF DESCRIPTION OF THE DRAWINGS

Some implementations of the present disclosure are described with respect to the following figures.

Figure 1:
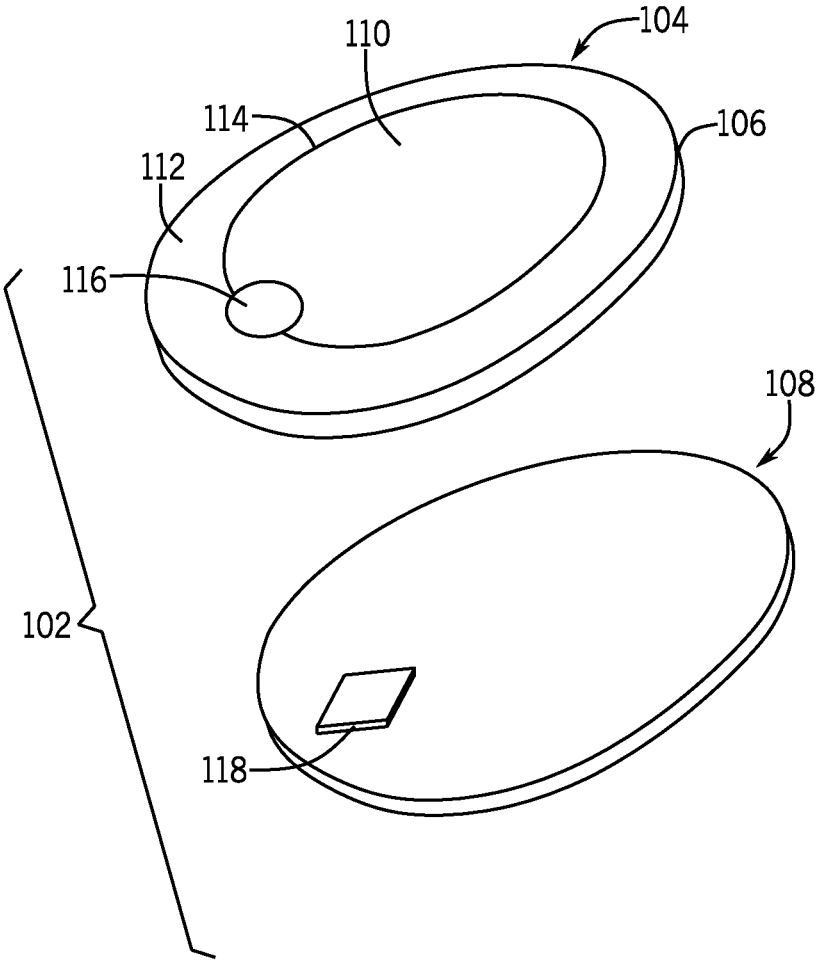
FIG. 1 is a perspective exploded view of an assembly that includes a cell and an actuator layer, according to some examples.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In the present disclosure, use of the term "a," "an", or "the" is intended to include the plural forms as well, unless the context clearly indicates otherwise. Also, the term "includes," "including," "comprises," "comprising," "have," or "having" when used in this disclosure specifies the presence of the stated elements, but do not preclude the presence or addition of other elements.

Examples of footwear include shoes, sandals, boots, socks, or any other article that is to be worn on a foot (or feet) of a user. The sole of a footwear is designed to support a foot of a user. The sole can refer generally to a footwear's underlying structure on which the user's foot is placed and which provides support for the user's foot. Footwear can be used in different activities, including walking, jogging, playing sports, standing, and so forth, which can be associated with different support and user comfort issues. Inadequate support for a user's feet can result in discomfort or pain to the user, and in some cases can lead to damage to the user's feet.

After a user purchases a footwear and finds that it does not provide adequate support or comfort (because the footwear does not provide adequate support for the user's intended activity), the user may either return the footwear to the retailer (which results in added cost to the retailer), or the user may purchase additional inserts to place in the footwear to add support or improve comfort (which results in added cost to the user). A user may also find that while a particular footwear is satisfactory for one type of activity (e.g., walking), the particular footwear may not be satisfactory for another type of activity (e.g., jogging). As a result, the user may purchase different pairs of footwear for different activities, which can lead to increased cost to the user.

In accordance with some implementations of the present disclosure, solutions are provided to dynamically adjust a footwear's support for a user's foot. Adjusting the support for a user's foot can refer to adjusting an amount of cushioning for the foot. Thus, when the user is engaged in a first activity (e.g., walking or standing), the footwear provides a first level of support. On the other hand, when the user is engaged in a second activity (e.g., jogging or running or playing sports), the footwear can provide a second level of support different from the first level of support.

In some implementations of the present disclosure, a sole layer of a sole of a footwear can include a cell that can be filled with a fluid. A fluid can refer to a gas, a liquid, a gas immersed with solid particles, or a liquid immersed with solid particles. As used here, a "cell" can refer to a containing structure, such as a pouch, pocket, or any other receptacle in which is provided an inner cavity. In addition, the sole layer includes a port between different chambers of the cell. Fluid flow restriction through the port can be adjusted dynamically as the user is engaged in an activity. In some implementations of the present disclosure, an actuator that includes a vibrator is provided to vibrate at different frequencies in response to detection of different forces on a footwear.

The sole can be formed of multiple layers (referred to as "sole layers"), where one sole layer of the multiple sole layers can include a cell according to some implementations of the present disclosure. In other examples, more than one sole layer can include a cell according to some implementations.

FIG. 1 is perspective view of an assembly 102 that can be affixed to or otherwise formed with a sole layer that is part of a footwear, according to some examples. The assembly 102 has a cell 104 with a housing structure 106, and an actuator layer 108 that has an actuator including a vibrator 118.

A vibrator can refer generally to a device that has a member (or multiple members) that shake back and forth in response to an input stimulus applied on the device. The input stimulus can include an electrical stimulus, in the form of an electrical voltage or current. In other examples, a different type of stimulus can be provided, including a magnetic field, an optical signal, and so forth. Changing the input stimulus to the vibrator can cause a change in the vibration frequency of the vibrator.

In more specific examples, the vibrator can be a piezoelectric vibrator, which can include an element formed from a piezoelectric material, where the element can be in the form of a plate, a bar, or a ring. Electrodes can be attached to the element formed of the piezoelectric material, where the electrodes can be used to excite the piezoelectric element at resonant frequencies of the piezoelectric element. Exciting the piezoelectric element with an input electrical energy causes the piezoelectric element to vibrate.

In FIG. 1, an upper portion of the housing structure 106 of the cell 104 is removed to allow the inner structures of the cell 104 to be visible. The housing structure 106 is a sealed structure that seals a fluid inside the cell 104.

In some examples, the housing structure 106 can be formed of a material including polyethylene. For example, the housing structure 106 can include polyethylene films that can be sealed together. In some examples, the films can be sealed using an ultrasonic sealing process. Ultrasonic sealing involves applying ultrasonic vibration to the polyethylene films to seal the films together. In other examples, other types of films or layers can be employed to form the cell 104.

FIG. 1 shows the cell 104 and the actuator layer 108 in an exploded view, where the actuator layer 108 is shown spaced apart from the cell 104 to better see elements of each of the cell 104 and the actuator layer 108. When the cell 104 and the actuator layer 108 are assembled together in a footwear, the actuator layer 108 is in contact with the cell 104, either in contact with a lower surface of the cell 104 (such as in the view of FIG. 1), or in contact with an upper surface of the cell 104 (in which case the actuator layer 108 can be provided above the cell 104 in the view of FIG. 1).

The cell 104 has a first inner chamber 110 and a second inner chamber 112 that are separated by a partition 114. The inner chambers 110 and 112 are sealed inside the housing structure 106 (such that fluid in the inner chambers 110 and 112 do not flow from the inner chambers 110 and 112 to a space outside the housing structure 106). The partition 114 can be a wall that surrounds the first inner chamber 110. The wall of the partition 114 can be generally have a circular or oval shape. In other examples, the wall of the partition 114 can have a different shape.

A port 116 is provided in the partition 114 to allow fluid to flow between the first inner chamber 110 and the second inner chamber 112. Although FIG. 1 shows just one port 116, it is noted that in other examples, more than one port can be provided in the partition 114 to allow fluid communication between the first and second inner chambers 110 and 112. Also, although FIG. 1 shows just two inner chambers 110 and 112 in the cell 104, it is noted that in other examples, there can be more than two inner chambers in the cell 104, with respective ports allowing for fluid communication between successive chambers.

Due to its proximity to the vibrator 118, the port 116 is a controllable port that can be adjusted to control an amount of fluid flow through the port 116. Adjusting the activation level of the vibrator 118 causes a change in fluid restriction through the port 116. Restricting fluid flow through a port can refer to reducing an amount of fluid flow through the port as compared to an amount when no restriction or less restriction is applied. Restricting fluid flow through a port can refer to either completely shutting off fluid flow through the port or allowing some amount of fluid flow through the port, where the amount is less than an amount that would normally flow through the port if fluid restriction were not applied.

In examples where the partition 114 includes an additional port (or additional ports), the additional port may not be a controllable port. In other words, fluid is allowed to flow through this additional port without a controllable restriction. In further examples, the additional port can also be a controllable port that can be controlled by a respective vibrator that is similar to the vibrator 118 in the actuator layer 108. In other examples, one vibrator 118 can control fluid flow through multiple controllable ports.

In some implementations of the present disclosure, vibration of the vibrator 118 changes a characteristic of the fluid in the port 116, where the change in characteristic of the fluid in the port 116 adjusts the fluid restriction in the port 116.

In some examples, the characteristic of the fluid that is changed in response to vibration of the vibrator includes a viscosity of the fluid. The fluid can have a viscosity that increases with increased stress (or increased shear) caused by vibration of the vibrator. For example, the fluid in the cell 104 is a non-Newtonian fluid. The viscosity of a non-Newtonian fluid is dependent on the rate of shear. Most fluids are non-Newtonian fluids. One type of non-Newtonian fluid is a dilatant fluid (or shear thickening fluid), which has a viscosity that increases with the shear strain.

In more specific examples, the fluid can include polyethylene glycol (PEG) in which is dispersed silica nano-particles, where the nano-particles can have diameters in the range of 400-600 nanometers (nm) in some examples. In other examples, nano-particles dispersed in a fluid can have different diameters. Other types of dilatant fluid in which particles are immersed can be employed. In other examples, other types of dilatant fluids can include a mixture of PEG and aluminum oxide, a mixture of PEG, silica, and graphene oxide, and so forth. In further examples, starch and water can be a dilatant fluid. In yet further examples, other dilatant fluids can be employed.

Figure 2:
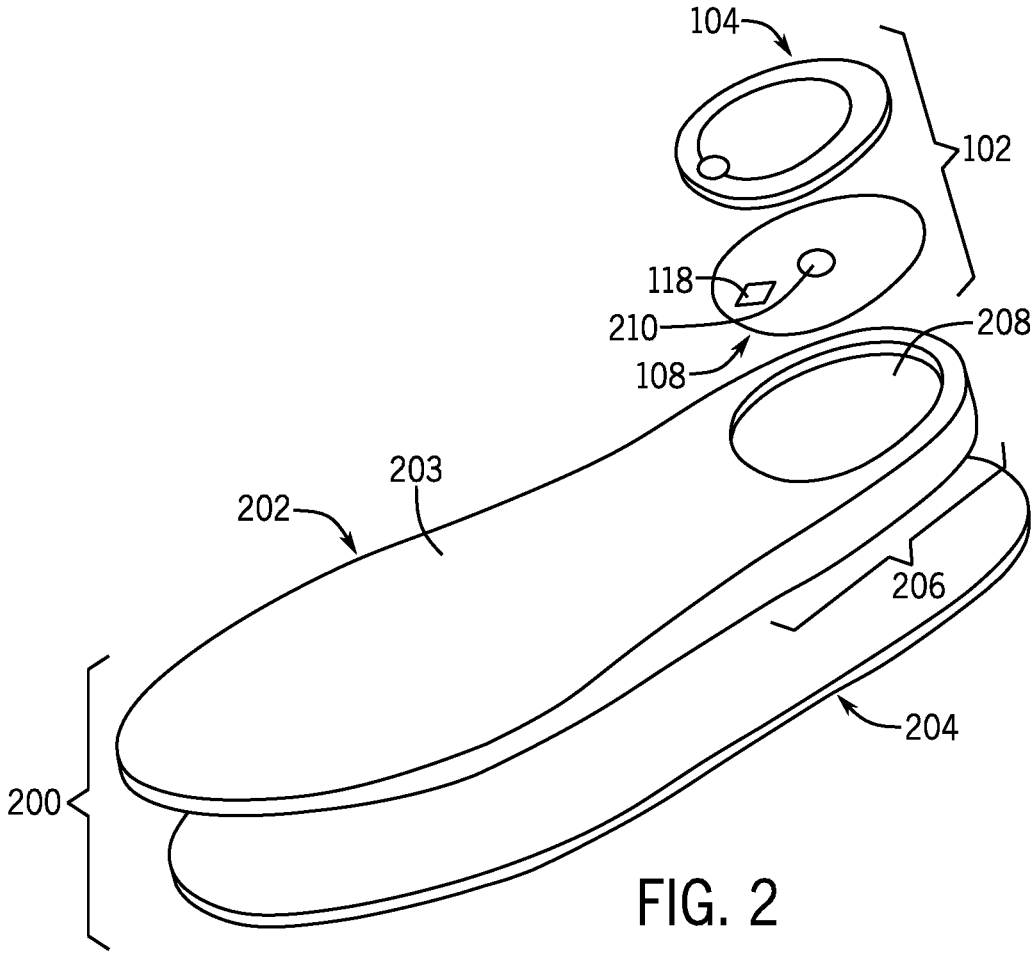
FIG. 2 is a perspective exploded view of a sole of a footwear, according to some examples.

FIG. 2 is a perspective exploded view of sole layers in a sole 200 for a footwear. The sole layers include a midsole layer 202 and an outer sole layer 204. The outer sole layer 204 is the bottom most layer of a sole in the views depicted in FIG. 2. The midsole layer 202 is the sole layer that is provided above the outer sole layer 204. The midsole layer 202 can be affixed to the outer sole layer 204, either by an adhesive or different fastener. Although just a few sole layers are shown as being part of the sole 200 shown in FIG. 2, it is noted that in other examples, a different number of sole layers can be provided as part of the sole 200.

Although not shown in FIG. 2, when assembling a footwear, an upper can be provided over the sole 200. An upper refers to the upper structure of the footwear that covers the upper part of the foot of a user. The upper can be formed of a fabric, leather, or any other type of material.

As shown in FIG. 2, a rear portion 206 of the midsole layer 202 has a receptacle 208 formed in an upper surface of the midsole layer 202. The receptacle 208 receives the assembly 102 of the cell 104 in the actuator layer 108. When the assembly 102 is placed in the receptacle 208, the top surface of the cell 104 can be flush with the top surface 203 of the midsole layer 202. The receptacle 208 is formed in a support substrate of the midsole layer 202.

As further shown in FIG. 2, a sensor 210 can be provided in the actuator layer 108, or alternatively, can be provided as part of another portion of the sole 200. The sensor 210 is used to detect a force applied by the user's foot when the user is standing on the sole 200, either when the user is in a still position (e.g., the user is standing up or is sitting on a chair or other furniture), or when the user is engaged in a physical activity, such as walking, jogging, running, sports, and so forth.

In some examples, the rear portion 206 of the midsole layer 202 in which the receptacle 208 is provided is adjacent the heel of the user's foot when the user wears a footwear including the assembly 102. Thus, the force applied on the sensor 210 is a force due to the heel of the user's foot pressing against the sensor 210. In some examples, the sensor 210 can be a piezoelectric sensor. A piezoelectric sensor converts a force applied on the piezoelectric sensor into electricity. An electrical signal is provided by the piezoelectric sensor to the vibrator 118. The amplitude of the electrical signal (voltage or current) provided by the piezoelectric sensor can be proportional to the amount of force applied by the heel of the user's foot. This in turn can adjust the vibration of the vibrator 118. A larger force detected by the piezoelectric sensor 210 can correspond to an electrical signal of a larger amplitude, which can in turn cause a vibration with a greater amplitude or frequency by the vibrator 118. Greater vibration by the vibrator 118 can in turn further increase the viscosity of the fluid in the cell 104, such that increased fluid restriction is provided through the port 116.

Generally, the vibrator 118 is activated in response to a signal from the sensor 210, where the vibrator 118 when activated causes a member(s) in the vibrator 118 to vibrate to transition a fluid in the port 116 between the first and second inner chambers 110 and 112 from a first state to a second state (where the first and second states correspond to different fluid viscosities) to change a flow restriction through the port.

An increased amount of vibration (e.g., vibration having greater amplitude or frequency) results in greater shear applied on the fluid that is in the port 116 of the cell 104. The increased shear causes an increase in the viscosity of the fluid. An increase in viscosity of the fluid in the port 116 results in an increased amount of restriction of fluid flow through the port 116. If the shear applied by the vibrator 118 is great enough, the fluid that is in the port 116 can increase its viscosity to a level such that the fluid effectively becomes a plug in the port 116, which can prevent any further fluid flow between the inner chambers 110 and 112. Effectively, if the shear is great enough, the fluid in the port 116 transitions from a liquid state to a solid state.

Figure 3:
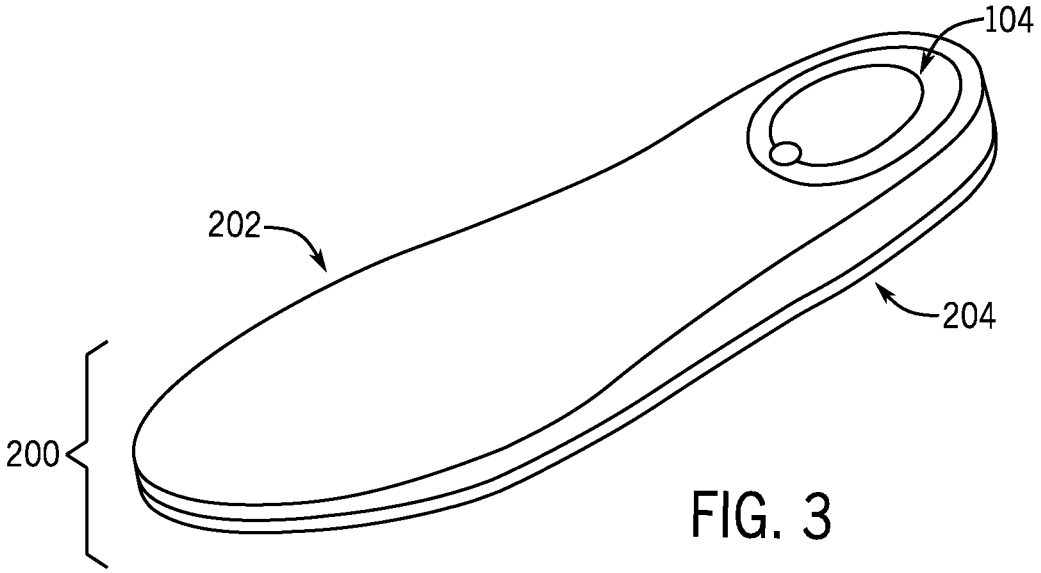
FIG. 3 is a perspective view of a sole of a footwear, according to some examples.

FIG. 3 is a perspective assembled view of the sole 200, which includes the outer sole layer 204, the midsole layer 202 affixed to the outer sole layer 204, and the assembly 102 received in the receptacle 208 of the midsole layer 202.

Figure 4A:
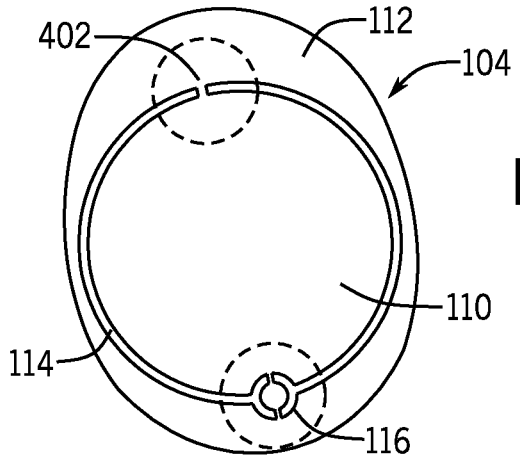
FIGS. 4A-4C are top views of a cell according to some examples.
Figure 4B:
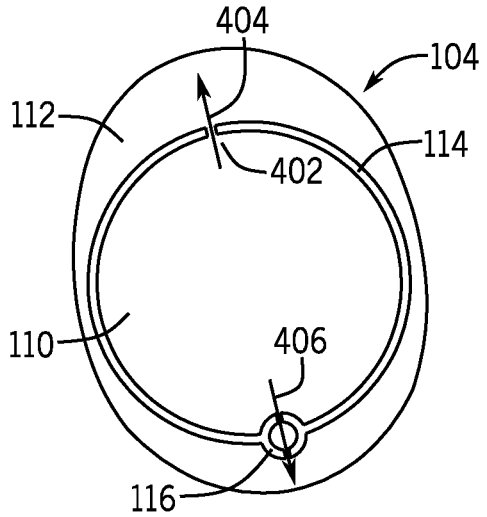
Figure 4C:
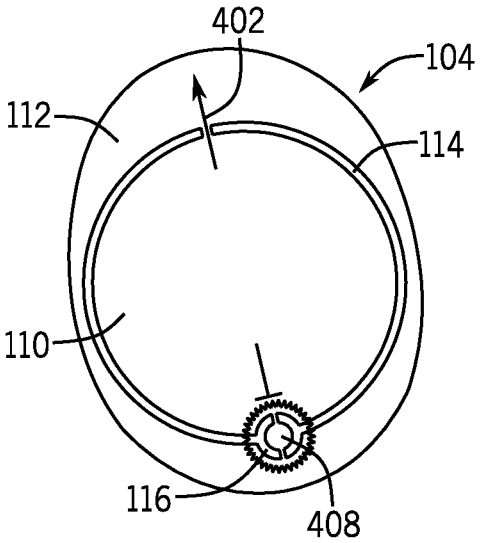

FIGS. 4A-4C are top views of an example of the cell 104, where the upper portion of the housing structure of the cell 104 removed. In the example of FIG. 4A, the partition 114 that separates the first inner chamber 110 from the second inner chamber 112 includes the controllable port 116 and another port 402. The port 116 is a controllable port based on vibration of the vibrator 118. In contrast, the port 402 is not associated with any type of actuator, and thus fluid flow through the port 402 is unrestricted.

FIG. 4B shows fluid flowing from the first inner chamber 110 to the second inner chamber 112, which can be caused by a user's heel applying a force on the cell 104. The fluid flow paths are depicted by arrows 404 and 406, where the fluid flow path 404 is through the unobstructed port 402, and the fluid flow path 406 is through the controllable port 116.

As the force applied by the user's heel increases, the vibration of the vibrator 118 increases the shear applied on the fluid that is in an inner port chamber 408 of the port 116. This increased shear causes an increase in viscosity of the fluid inside the inner port chamber 408, which can increase fluid flow restriction in the port 116. If the viscosity is increased to a sufficiently high level, the fluid in the inner port chamber 408 can effectively act as a plug, to prevent any further fluid flow through the port 116.

In the example of FIG. 4C, once the port 116 is plugged, fluid can only flow through the unobstructed port 402 from the inner chamber 110 to the inner chamber 112. In other examples, the unobstructed port 402 can be removed, such that there is only the controllable port 116 between the inner chambers 110 and 112. As further examples, there can be additional unobstructed port(s) in the partition 114 between the inner chambers 110 and 112. In further examples, there can be an additional controllable port, similar to the port 116, in the partition 114.

Figure 5:
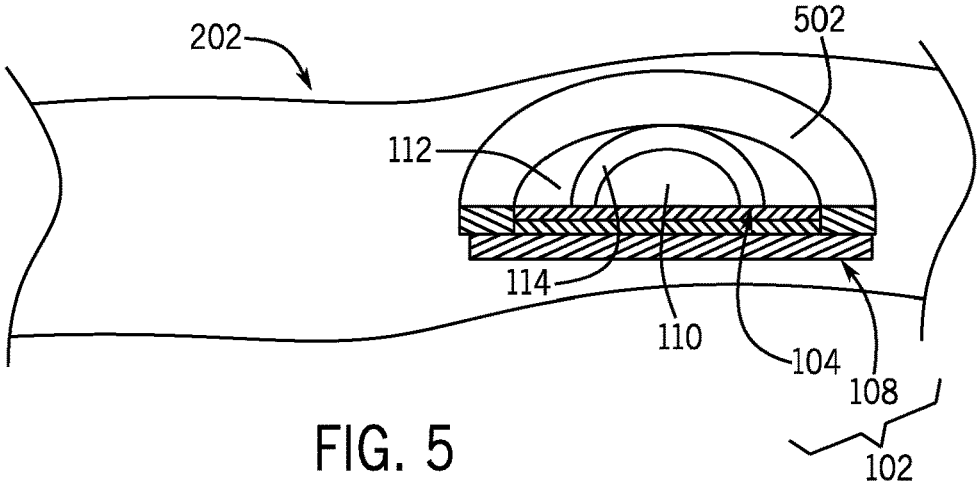
FIG. 5 is a sectional view of a sole layer that includes a cell and an actuator layer, according to further examples.

When a force is removed from the cell 104, a bias element can push fluid from the second inner chamber 112 back into the first inner chamber 110, such as through the ports 402 and 116. FIG. 5 is a cross-sectional view of the midsole layer 202 and the assembly 102 that includes the cell 104 and the actuator layer 108. The midsole layer 202 can be formed of any or various different types of materials, including, for example, elastomer, a foam, and so forth.

As further shown in FIG. 5, a bias element that includes a back pressure foam 502 is provided. The back pressure foam 502 can be considered to be part of the midsole layer 202 or the cell 104. A back pressure foam 502 is a foam that is arranged in a shape (circular or oval shape) where the foam applies an inward radial force. This inward radial force tends to push fluid from the inner chamber 112 to the inner chamber 110, through the port 116.

In other examples, instead of using the back pressure foam 502, a different bias member or element can be used to apply a force generally in a radially inward direction of the cell 104, for moving fluid from the second inner chamber 112 to the first inner chamber 110.

Figure 6:
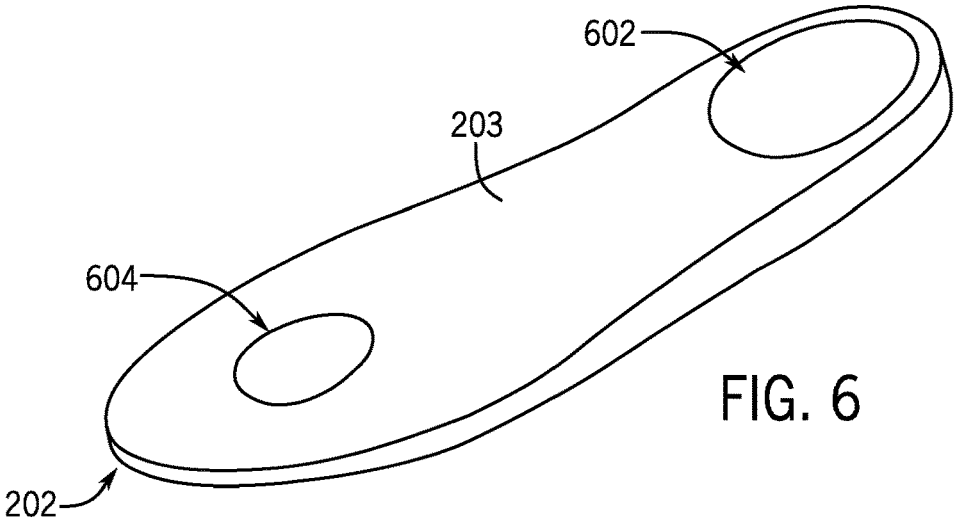
FIG. 6 is a perspective view of a sole layer including multiple cells, according to alternative examples.

In the foregoing examples, reference is made to providing one cell in the midsole layer 202. In other examples, the midsole layer 202 can be provided with more than one cell, such as cells 602 and 604 depicted in FIG. 6. The cell 602 can be provided to support the heel of the user's foot, while the cell 604 can be used to support the toe box of the user's foot. In other examples, the midsole layer 202 can include further cells. Each of the cells 602 and 604 can be received in a respective receptacle (similar to the receptacle 208) formed in the top surface 203 of the midsole layer 202. Also, although not shown in FIG. 6, each of the cells 602 and 604 is associated with a respective actuator layer, similar to the actuator layer 108 shown in FIG. 6. The respective actuator layer can control fluid restriction in a respective port of each cell.

In examples where the midsole layer 202 is provided with multiple cells, the cells 602 and 604 can be injected with different types of fluid. For example, the cell 602 can include a first type of fluid, and the cell 604 can include a second different type of fluid. The different types of fluids can respond differently to increased shear applied by the vibrator 118.

Figure 7:
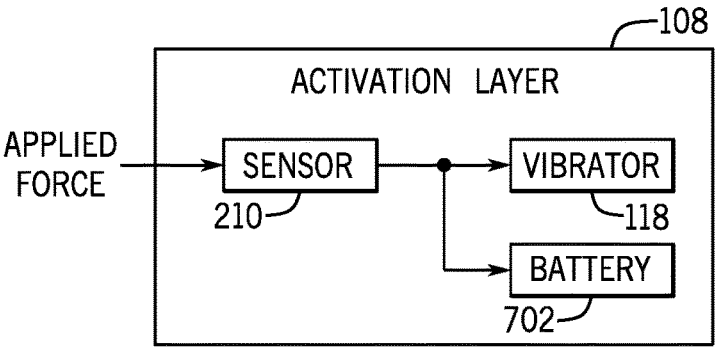
FIG. 7 is a block diagram of an actuator layer, according to some examples.

FIG. 7 is a block diagram of components of the actuator layer 108, according to some examples. The actuator layer 108 includes the sensor 210, the vibrator 118, and a battery 220 to supply power to the sensor 210 and the vibrator 118. In some examples, the battery 220 can be a rechargeable battery, which can be recharged using electrical power produced in response to force applied by a user's foot, such as when the user is walking, jogging, running, or engaged in another activity. In examples where the sensor 210 is a piezoelectric sensor, an applied force (from the user's foot) is converted by the piezoelectric sensor to electrical energy, which is provided as a signal to cause activation of the vibrator 118, and which can also recharge the battery 702.

In other examples, instead of using the battery 702, a capacitor can be used, where the capacitor can be charged by the piezoelectric sensor during movement of the user's foot, and the charge in the capacitor is sufficient to operate the piezoelectric sensor and the vibrator 118.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. An assembly for a footwear, comprising:

a cell comprising a housing structure, the cell comprising a first chamber to contain a fluid;

a port; and a vibrator responsive to activation to cause a reduction in fluid flow through the port between the first chamber and a second chamber by changing a characteristic of the fluid in the port.

2. The assembly of claim 1, wherein the vibrator comprises a piezoelectric vibrator.

3. The assembly of claim 1, wherein a vibration of the vibrator causes a viscosity of the fluid to change.

4. The assembly of claim 1, wherein a vibration of the vibrator causes a transition of the fluid in the port from a liquid state to a solid state.

5. The assembly of claim 1, further comprising:

a sensor to detect force applied by a foot on the cell.

6. The assembly of claim 5, wherein the sensor is to provide an activation signal to the vibrator in response to the detected force.

7. The assembly of claim 6, wherein the sensor comprises a piezoelectric sensor.

8. The assembly of claim 1, wherein the vibrator is to vibrate at different frequencies in response to detection of respective different forces, and wherein vibration of the vibrator at the different frequencies is to cause the fluid in the port to exhibit different viscosities.

9. The assembly of claim 1, further comprising a sole layer including the cell, wherein the cell is a first cell, and the sole layer further comprises:

a second cell in the sole layer, the second cell comprising:

a first chamber containing a fluid;

a second port through which the fluid in the first chamber of the second cell is able to flow to a second chamber of the second cell; and a second vibrator responsive to activation to cause a reduction in fluid flow through the second port between the first chamber of the second cell and the second chamber of the second cell by changing a characteristic of the fluid in the second port.

10. The assembly of claim 9, wherein the first cell contains a first type of fluid, and the second cell contains a second type of fluid different from the first type of fluid.

11. A sole for a footwear, comprising:

a sensor;

a plurality of sole layers, a first sole layer of the plurality of sole layers comprising:

a cell comprising a first chamber and a second chamber;

a port between the first and second chambers; and a vibrator responsive to activation responsive to a signal from the sensor, the vibrator when activated causing a member to vibrate to transition a fluid in the port between the first and second chambers from a first state to a second state to change a flow restriction through the port.

12. The sole of claim 11, wherein the transition of the fluid from the first state to the second state causes a reduction in fluid flow through the port.

13. The sole of claim 11, wherein the vibrator is a piezoelectric vibrator.

14. A footwear comprising:

a sole comprising a plurality of layers, a first layer of the plurality of layers comprising a support substrate providing a receptacle; and a cell received in the receptacle of the first layer, the cell comprising:

a first chamber and a second chamber;

a port between the first and second chambers; and a vibrator proximate the port, the vibrator to vibrate in response to activation by a detected force on the footwear, the vibration to increase a fluid flow restriction through the port.

15. The footwear of claim 14, wherein in response to a force applied on the cell, a fluid is to flow from the first chamber to the second chamber through the port, the cell further comprising:

a bias member to push the fluid from the second chamber to the first chamber through the port once the force is removed from the cell.

* * * * *